US009948027B2

(12) United States Patent
Sandwith

(10) Patent No.: US 9,948,027 B2
(45) Date of Patent: Apr. 17, 2018

(54) HIGH POWER ELECTRICAL CONNECTOR WITH STRAIN RELIEF

(71) Applicant: Amphenol Corporation, Wallingford, CT (US)

(72) Inventor: Graeme R. Sandwith, Haywards Heath (GB)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 15/695,511

(22) Filed: Sep. 5, 2017

(65) Prior Publication Data

US 2018/0006396 A1 Jan. 4, 2018

Related U.S. Application Data

(63) Continuation of application No. 14/860,177, filed on Sep. 21, 2015, now abandoned.

(51) Int. Cl.
*H01R 13/58* (2006.01)
*H01R 13/595* (2006.01)

(52) U.S. Cl.
CPC ..... *H01R 13/5812* (2013.01); *H01R 13/58* (2013.01); *H01R 13/595* (2013.01)

(58) Field of Classification Search
CPC .. H01R 13/5812; H01R 13/58; H01R 13/582; H01R 13/585; H01R 13/5804; H01R 13/5829; H01R 13/59; H01R 13/595; H01R 23/661
USPC ..... 439/469, 449, 462–464, 471, 451, 452
See application file for complete search history.

(56) References Cited

U.S. PATENT DOCUMENTS 1,858,816 A * 5/1932 Burkhardt ..... H01B 17/306 439/448
2,189,987 A * 2/1940 Kellems ..... H01R 13/562 138/109
2,226,733 A * 12/1940 McLarn ..... H01B 7/00 174/117 F
2,824,290 A * 2/1958 Archer ..... H01R 13/6276 174/541
3,040,287 A * 6/1962 Agron ..... H01R 13/621 439/275
3,369,072 A * 2/1968 Harris ..... H01R 4/00 174/74 R
3,633,155 A * 1/1972 Taylor ..... H01R 13/523 439/204
3,818,420 A * 6/1974 Barr ..... H01R 13/625 439/261

(Continued)

*Primary Examiner* — Tulsidas C Patel
*Assistant Examiner* — Travis Chambers
(74) *Attorney, Agent, or Firm* — Blank Rome LLP; Tara L. Marcus

(57) ABSTRACT

A high power electrical connector that includes a housing that has an interface end for mating with a complimentary connector and a cable termination end opposite the interface end for terminating a high power cable. The housing is insulative. An extended anchor member is fixed to an outer surface of the housing. The extended anchor member has a locking end, a strain relief end, and an intermediate extended body therebetween separating the locking end and the strain relief end. A gripping member has a coupling end coupled to the extended anchor member at the strain relief end thereof, and a flexible body configured to provide strain relief to the high power cable.

19 Claims, 2 Drawing Sheets

(56) References Cited

U.S. PATENT DOCUMENTS 4,070,083 A * 1/1978 DiPalma ..... H01R 13/562 439/445
4,310,213 A * 1/1982 Fetterolf, Sr. ..... H01R 13/516 439/320
4,629,275 A * 12/1986 Maul ..... H01R 13/58 174/DIG. 8
4,666,229 A * 5/1987 Grand ..... H01R 13/58 439/451
5,015,805 A * 5/1991 Beckloff ..... H01R 9/05 174/75 C
5,089,669 A * 2/1992 Piper ..... H01B 7/0823 139/425 R
5,336,108 A * 8/1994 Lin ..... H01R 13/59 439/462
6,309,258 B1 * 10/2001 Measley ..... H01R 11/05 439/224
6,419,519 B1 * 7/2002 Young ..... H01R 13/5812 439/446
6,582,248 B2 * 6/2003 Bachman ..... H01R 13/516 439/447
6,974,169 B1 * 12/2005 Upton ..... F16L 55/1652 24/115 N
7,029,315 B2 * 4/2006 Dang ..... H01R 13/5841 439/468
7,357,579 B2 * 4/2008 Feldner ..... G02B 6/3887 385/56
7,399,194 B1 7/2008 Gilliam
7,442,096 B1 10/2008 Gilliam
7,544,085 B2 * 6/2009 Baldwin ..... H01R 13/5829 439/446
7,621,767 B2 * 11/2009 Stagi ..... H01B 7/285 439/204
7,695,333 B2 * 4/2010 Strickland, Jr. .... H01R 13/5221 439/737
7,708,576 B2 5/2010 Hughes et al.
7,837,495 B2 11/2010 Baldwin et al.
7,854,636 B2 12/2010 Gilliam
7,892,047 B2 2/2011 Strickland, Jr.
8,157,594 B2 4/2012 Gilliam
8,215,884 B2 * 7/2012 Bulow ..... H01R 13/622 411/116
8,574,006 B2 11/2013 Gilliam
8,961,205 B2 2/2015 Sandwith
9,022,805 B2 * 5/2015 Lai ..... H01R 9/2416 439/596
9,081,151 B2 * 7/2015 Chen ..... G02B 6/3878
9,184,534 B1 * 11/2015 Errato, Jr. ..... H01R 13/562
2011/0269331 A1 11/2011 Saber
2013/0084740 A1 * 4/2013 Paynter ..... B29C 45/14598 439/604
2015/0038008 A1 2/2015 Gilliam
2015/0038021 A1 2/2015 Gilliam
2015/0364885 A1 * 12/2015 Garvey ..... H01R 31/06 439/367
2016/0248238 A1 * 8/2016 Warren ..... H02G 3/0481

* cited by examiner

HIGH POWER ELECTRICAL CONNECTOR WITH STRAIN RELIEF

RELATED APPLICATION

The present application is a continuation of U.S. application Ser. No. 14/860,177,filed Sep. 21, 2015, the entire disclosure of which is incorporated by reference herein.

FIELD OF THE INVENTION

The present invention relates to high power electrical connector that includes a strain relief system for preventing separation of the high power cable from the connector.

BACKGROUND OF THE INVENTION

Oil and gas drilling rigs are located throughout the world and require high power to be supplied to the major machinery on the rigs. The rigs used for drilling to land based fossil reserves are typically smaller than those used on offshore rigs and are designed to be easily disassembled and loaded onto trucks for transport to alternate locations. Offshore rigs are larger and can be moved completely to a new location. This distinction in operating practice necessitates the use of connectors on land drilling rigs for easy strip down and allows for hard wiring on the rigs built for offshore applications.

The field assembly and installation of many inland drilling rigs has led to the widespread use of single pole electrical connectors capable of safely connecting the load supply to high powered electrical motors used on the rigs. A typical connector used in this service is the R49 series connector. This connector is designed to carry a typical supply of 1000 v and 1000 amps. Requirements for a R49 series connector include that the operator is fully protected from the dangerous supply, that it can be locked in the mated condition when in service, that it remains unaffected by harsh environmental conditions experienced, that it can be easily and safely disconnected when required, and that it must be robust and be capable of withstanding significant rough handling in the field. An exemplary R49 series connector is disclosed in U.S. Pat. No. 8,961,205 to Graeme Sandwith, the contents of which are incorporated herein by reference.

Due to the heavy nature of the high power cables used for such major machinery, a need exists for adequate strain relief for the cables to prevent the cables from separating from the connectors and potentially exposing operators to the energized power conductors.

SUMMARY OF THE INVENTION

Accordingly, the present invention may provide a high power electrical connector that includes a housing that has an interface end for mating with a complimentary connector and a cable termination end opposite the interface end for terminating a high power cable. The housing is insulative. An extended anchor member is fixed to an outer surface of the housing. The extended anchor member has a locking end, a strain relief end, and an intermediate extended body therebetween separating the locking end and the strain relief end. A gripping member has a coupling end coupled to the extended anchor member at the strain relief end thereof, and a flexible body configured to provide strain relief to the high power cable.

The present invention may further provide a high power electrical connector that includes a housing that has an interface end for mating with a complimentary connector and a cable termination end opposite the interface end for terminating a high power cable. The housing is formed of an insulative material. An extended anchor member is fixed to an outer surface of the housing. The extended anchor member has a locking end, a strain relief end, and an intermediate extended body therebetween separating the locking end and the strain relief end. The extended anchor member is formed of a material more rigid than the material of the housing. A gripping member has a coupling end coupled to the extended anchor member at the strain relief end thereof, and a flexible body that is configured to provide strain relief to the high power cable. The coupling end is more rigid than the flexible body.

The present invention may yet further provide a high power electrical connector that includes a housing that has an interface end for mating with a complimentary connector and a cable termination end opposite the interface end for terminating a high power cable. The housing is formed of rubber. An extended anchor member is fixed to an outer surface of the housing. The extended anchor member has a locking end with an annular channel, a strain relief end with an annular groove, and an intermediate extended body therebetween separating the locking end and the strain relief end. The annular groove is defined between a tapered transition shoulder and an end face annular lip of the extended anchor member. The extended anchor member is formed of metal or rigid plastic. A gripping member has a coupling end coupled to the annular groove of the extended anchor member at the strain relief end thereof, and a flexible body that is configured to provide strain relief to the high power cable. The coupling end is more rigid than the flexible body Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Referring to FIGS. 1-3, 4A, and 4B, the present invention relates to an electrical connector 100, particularly for use in high power applications, and a cable strain relief system for the electrical connector 100. An exemplary high power application may be supplying power (e.g. 1000V and 1000 AMPS) to major machinery, such as machinery on an oil drilling rig, such as an R49 series connector. The electrical connector 100 of the present invention is preferably ruggedized to meet harsh environmental conditions. The electrical connector 100 preferably terminates a high power cable C and generally includes an insulative housing 102, an extended anchor member 104 fixed to the housing 102, and a gripping member 106 for providing strain relief to the high power cable. The electrical connector 100 and strain relief system of the present invention is designed such that even given the size and weight of the cable used to supply the high amperage current, the cable is protected against being ripped out of the connector, thereby avoiding exposure of the power conductors to an operator.

Figure 1:
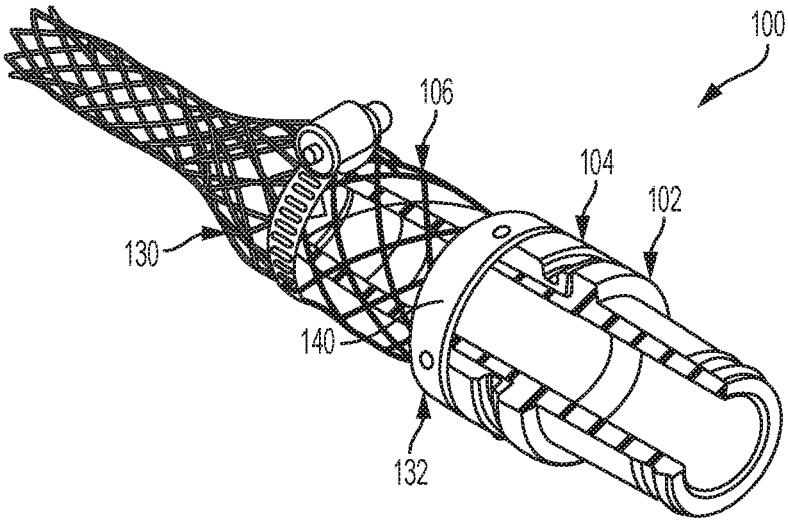
FIG. 1 is a partial perspective view of an electrical connector according to an exemplary embodiment of the present invention, showing the electrical connector with a portion of its housing removed and showing the electrical connector coupled to a cable gripping member.
Figure 2:
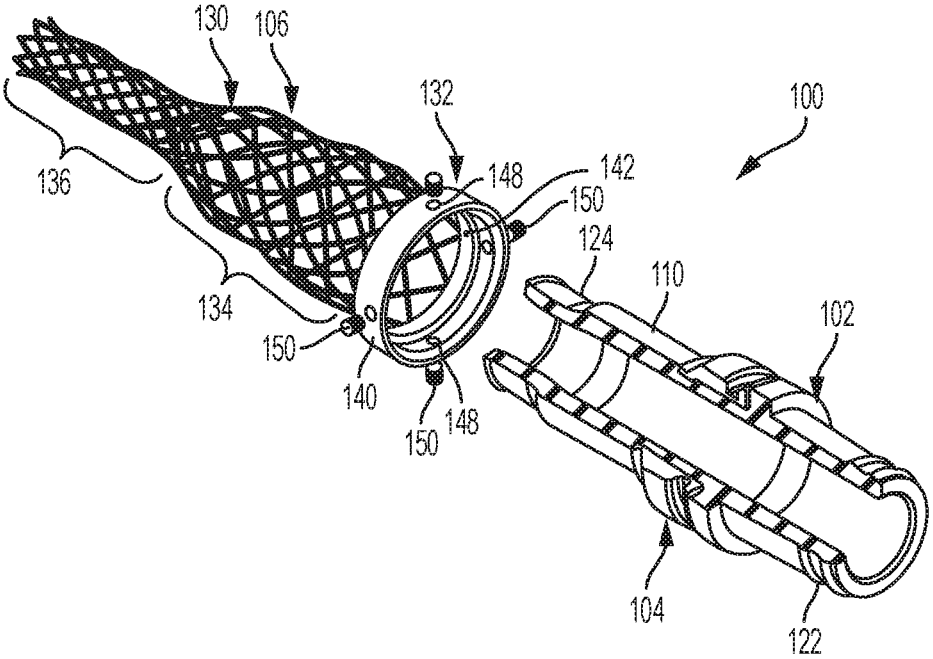
FIG. 2 is an exploded perspective view of the electrical connector illustrated in FIG. 1.
Figure 3:
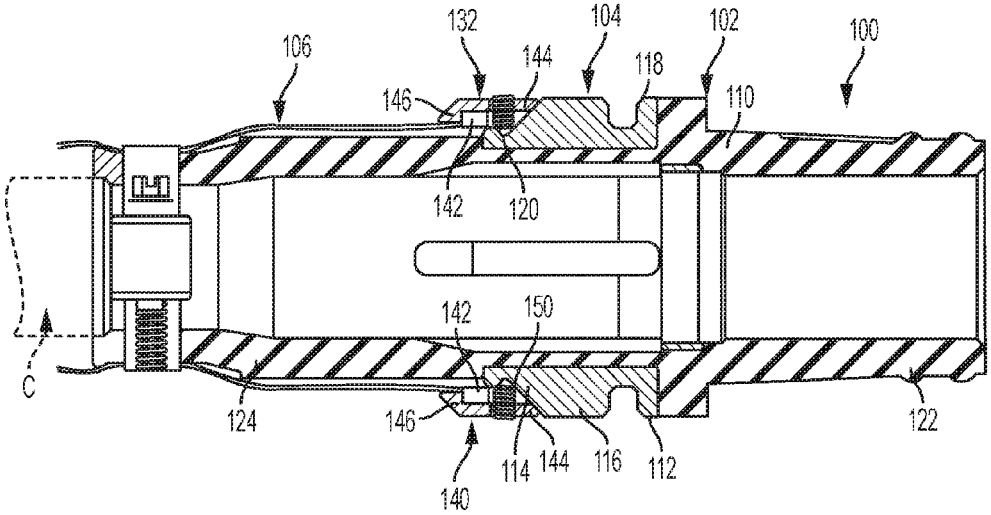
FIG. 3 is a cross-sectional view of the electrical connector illustrated in FIG. 1.

As seen in FIGS. 1-3, the housing 102 supports a contact (not shown) connected to the power conductors of the high power cable C in a manner well known in the art. The housing 102 has a generally cylindrical body 110 with an interface end 122 configured to mate with a complementary connector and an opposite cable termination end 124 that terminates the high power cable C. The housing 102 is preferably made of a rugged material, such as rubber, and more preferably a heavy industrial thermoset rubber. A rubber material for the connector housing 102 is preferred because such material is non-conductive and therefore extremely safe and highly corrosion resistant.

Figure 4A:
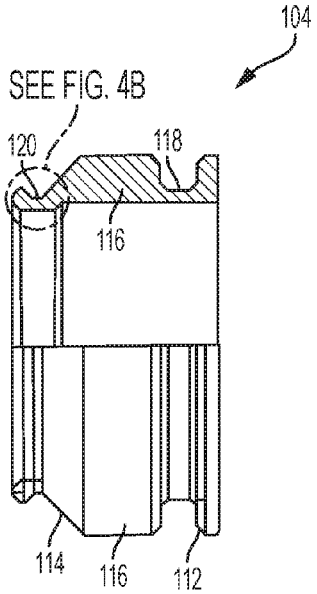
FIG. 4A is a cross-sectional view of an anchor member of the electrical connector illustrated in FIG. 1.
Figure 4B:
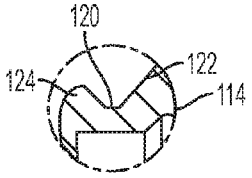
FIG. 4B is an exploded partial cross-sectional view of the anchor member illustrated in FIG. 4A.

As seen in FIGS. 3, 4A, and 4B, the extended anchor member 104 is fixed to the outer surface of the housing body 110. The extended anchor member 104 is fixed to the housing 102 in any known manner, such as by extrusion or adhesive bonding. Alternatively, the extended anchor member 104 may be overmolded to the housing body 110. The extended anchor member 104 is preferably a one-piece member that is formed a material more rigid than the housing 102, such as metal, like stainless steel, or a rigid plastic, to facilitate attachment to the gripping member 106. The extended anchor member 104 has a generally ring or tubular shape that preferably has three sections including a locking end 112, a strain relief end 114, and an intermediate extending body 116 therebetween separating the locking end 112 and the strain relief end 114. The locking end 112 may include an annular channel 118 that is preferably U-shaped. The annular channel 118 is designed to accept a locking mechanism, such as a prong or hasp, for coupling the electrical connector 100 to its complementary connector. The strain relief end 114 is opposite the locking end 112 and includes an annular groove 120. The annular groove 120 is defined between a tapered transition shoulder 122 extending from the intermediate extending body 116 and an annular lip 124 at the end face of the strain relief end 114, as best seen in FIG. 4B. The width of the annular groove 120 is preferably substantially smaller than the width of the annular channel 118, as best seen in FIG. 4A.

As seen in FIGS. 1 and 2, the gripping member 106 is preferably a basket weave grip that provides strain relief to the high power cable C. The weave of the gripping member 106 is designed such that the more pulling force that is applied to it, the tighter the grip becomes on the cable. The gripping member 106 generally includes a flexible body 130 and a coupling end 132. In a preferred embodiment, the flexible body 130 of the gripping member 106 is a dual diameter weave that reduces down in size to tightly hold and hug the cable C. In particular, the flexible body 130 may have a first diameter section 134 sized to receive and fit over the strain relief end 114 of the connector housing 102 and a second diameter section 136 sized to hug the cable C. Because the second diameter section 136 is different, that is smaller than, the first diameter section 134, improved strain relief is provided because the gripping member 106, and specifically the second diameter section 136, closely fits and grips the outer diameter of the cable C. The diameter of the first diameter section 134 may be up to five times the diameter of the diameter of the second diameter section 136. The weave of the flexible body 130 is preferably formed of metal. The first diameter section 134 may be a double weave, and the second diameter section 136 a single weave, to provide more rigidity to the first section 134 of the flexible body 130, for capturing the cable termination end 124 of the housing 102.

The coupling end 132 of the gripping member 106 is preferably more rigid than the flexible body 130 to facilitate attachment of the gripping member 106 to the connector housing 102. The coupling end 132 preferably includes primary and secondary rings 140 and 142. The primary ring 140 may larger than the secondary ring 142 to receive the second ring 142. The primary ring 140 includes a main body 144 with a tail end 146 facing the strain relief end 114, as best seen in FIG. 3, that define an inner area for receiving the secondary ring 142. The rings 140 and 142 may be attached to one another. Alternatively, the first and second rings 140 and 142 may be integrally formed as one ring.

At least the primary ring 140 includes one or more holes 148 (FIG. 2) in its main body 144 for receiving one or more corresponding fasteners 150 for attaching the gripping member 106 to the extended anchor member 104 on the connector housing 102. In particular, the fasteners 150 extend through the respective holes 148 in the coupling end first ring 140 and into the annular groove 120 at the strain relief end 114 of the extended anchor member 104. In a preferred embodiment, the fasteners 150 are pointed screws that are screwed into the groove 120. Alternatively, the fasteners 150 may be eliminated and the coupling end 132 of the gripping member 106 may be bonded directly to the strain relief end 114, such as by adhesive.

While a particular embodiment has been chosen to illustrate the invention, it will be understood by those skilled in the art that various changes and modifications can be made therein without departing from the scope of the invention as defined in the appended claims. For example, although the gripping member 106 is preferably a dual diameter weave, as described above, the gripping member 106 may also be a standard basket weave for gripping cables. Also, although the present invention is described for use with machinery associate with oil drilling, the preset invention may be used for any supplication requiring high power and high power cables.

What is claimed is:

1. A high power electrical connector, comprising:

a housing having an interface end for mating with a complimentary connector and a cable termination end opposite said interface end for terminating a high power cable, said housing being insulative;

an extended anchor member fixed to an outer surface of said housing, said extended anchor member having a locking end, a strain relief end, and an intermediate extended body therebetween separating said locking end and said strain relief end; and a gripping member having a coupling end coupled to said extended anchor member at said strain relief end thereof, and a flexible body configured to provide strain relief to the high power cable, wherein said strain relief end of said extended anchor member includes an annular groove for coupling to said coupling end of said gripping member, said annular groove receives and engages one or more fastener members, and said one or more fastener members engages said coupling end of said gripping member, and said locking end of said extended anchor member includes an annular channel for receiving a locking mechanism.

2. A high power electrical connector according to claim 1, wherein said coupling end of said gripping member includes a substantially rigid first ring that receives a substantially rigid second ring, said first and second rings are separate or integral; and said one or more fastener members extends through said first ring.

3. A high power electrical connector according to claim 1, wherein said housing is formed of rubber; and said extended anchor member is formed as one-piece of metal or rigid plastic.

4. A high power electrical connector according to claim 1, wherein said flexible body of said gripping member is a metal basket weave adapted to grip the high power cable.

5. A high power electrical connector according to claim 4, wherein said metal basket weave includes a first diameter section and a second diameter section, said first diameter section is larger than said second diameter section, said first diameter section is sized to receive said cable termination end of said housing, and said second diameter section is sized to receive the high power cable.

6. A high power electrical connector according to claim 5, wherein a diameter of said first diameter section is about five times larger than a diameter of said second diameter section.

7. A high power electrical connector according to claim 5, wherein said first diameter section is a double weave; and said second diameter section is a single weave.

8. A high power electrical connector, comprising:

a housing having an interface end for mating with a complimentary connector and a cable termination end opposite said interface end for terminating a high power cable, said housing being formed of an insulative material;

an extended anchor member fixed to an outer surface of said housing, said extended anchor member having a locking end, a strain relief end, and an intermediate extended body therebetween separating said locking end and said strain relief end, said locking end of said extended anchor member includes an annular channel for receiving a locking mechanism, said strain relief end of said extended anchor member includes an annular groove, and said extended anchor member being formed a material more rigid than said material of said housing;

a gripping member having a coupling end coupled to said extended anchor member at said strain relief end thereof, and a flexible body configured to provide strain relief to the high power cable, said coupling end being more rigid than said flexible body, and said coupling end of said gripping member includes a first ring coupled to said annular groove and a second ring received in said first ring, said second ring being separate or integral with said first ring.

9. A high power electrical connector according to claim 8, further comprising one or more fasteners that extend through said first ring and into said annular groove.

10. A high power electrical connector according to claim 8, wherein said extended anchor member is a one-piece member formed of metal or rigid plastic; and said housing is formed of rubber.

11. A high power electrical connector according to claim 8, wherein said flexible body of said gripping member is a metal basket weave adapted to grip the high power cable.

12. A high power electrical connector according to claim 11, wherein said metal basket weave includes a first diameter section and a second diameter section, said first diameter section is larger than said second diameter section, said first diameter section is sized to receive said cable termination end of said housing, and said second diameter section is sized to receive the high power cable.

13. A high power electrical connector according to claim 12, wherein a diameter of said first diameter section is about five times larger than a diameter of said second diameter section.

14. A high power electrical connector, comprising:

a housing having an interface end for mating with a complimentary connector and a cable termination end opposite said interface end for terminating a high power cable, said housing being formed of rubber;

an extended anchor member fixed to an outer surface of said housing, said extended anchor member having a locking end with an annular channel, a strain relief end with an annular groove, and an intermediate extended body therebetween separating said locking end and said strain relief end, said annular groove being defined between a tapered transition shoulder and an end face annular lip of said extended anchor member, said extended anchor member being formed of metal or rigid plastic;

a gripping member having a coupling end coupled to said annular groove of said extended anchor member at said strain relief end thereof, and a flexible body configured to provide strain relief to the high power cable, said coupling end being more rigid than said flexible body; and one or more fasteners extending through said coupling end of said gripping member and into said annular groove of said extended anchor member.

15. A high power electrical connector according to claim 14, wherein said flexible body of said gripping member is a metal weave, said weave having a first diameter section for receiving said cable termination end of said housing that is substantially larger than a second diameter section for receiving the high power cable.

16. A high power electrical connector according to claim 15, wherein a diameter of said first diameter section is about five times larger than a diameter of said second diameter section.

17. A high power electrical connector according to claim 16, wherein said coupling end of said gripping member includes first and second rings, said first ring receives said second ring, and said first and second rings are either separate or integral.

18. A high power electrical connector, comprising:

a housing having an interface end for mating with a complimentary connector and a cable termination end opposite said interface end for terminating a high power cable, said housing being insulative;

an extended anchor member fixed to an outer surface of said housing, said extended anchor member having a locking end, a strain relief end, and an intermediate extended body therebetween separating said locking end and said strain relief end; and a gripping member having a coupling end coupled to said extended anchor member at said strain relief end thereof, and a flexible body configured to provide strain relief to the high power cable, said flexible body being a metal basket weave adapted to grip the high power cable, said metal basket weave including a first diameter section and a second diameter section, said first diameter section being larger than said second diameter section, said first diameter section being sized to receive said cable termination end of said housing, and said second diameter section being sized to receive the high power cable.

19. A high power electrical connector, comprising:

a housing having an interface end for mating with a complimentary connector and a cable termination end opposite said interface end for terminating a high power cable, said housing being formed of an insulative material;

an extended anchor member fixed to an outer surface of said housing, said extended anchor member having a locking end, a strain relief end, and an intermediate extended body therebetween separating said locking end and said strain relief end, said locking end of said extended anchor member including an annular channel for receiving a locking mechanism, said strain relief end of said extended anchor member including an annular groove, and said extended anchor member being formed a material more rigid than said material of said housing;

a gripping member having a coupling end coupled to said extended anchor member at said strain relief end thereof, said coupling end of said gripping member including at least a first ring coupled to said annular groove, and a flexible body configured to provide strain relief to the high power cable, said coupling end being more rigid than said flexible body; and one or more fasteners extend through said first ring and into said annular groove of said gripping member.

* * * * *